United States Patent [19]

Sato

[11] 3,931,792

[45] Jan. 13, 1976

[54] ABRASIVE LIQUID DEVELOPING APPARATUS

[75] Inventor: Masamichi Sato, Tokyo, Japan

[73] Assignee: Rank Xerox Ltd., London, England

[22] Filed: Feb. 1, 1974

[21] Appl. No.: 438,893

[52] U.S. Cl. ..... 118/637; 118/DIG. 23; 355/3 P; 427/17

[51] Int. Cl.[2] ..... G03G 15/10

[58] Field of Search ..... 355/10, 3 P; 118/637, DIG. 23; 117/37 LE

[56] References Cited

UNITED STATES PATENTS

| | | | |
|---|---|---|---|
| 2,974,632 | 3/1961 | Westervelt et al. | 118/637 |
| 3,247,007 | 4/1966 | Oliphant | 118/637 |
| 3,343,956 | 9/1967 | Wright | 118/637 |
| 3,672,884 | 6/1972 | Mayer | 118/DIG. 23 |

FOREIGN PATENTS OR APPLICATIONS

| | | | |
|---|---|---|---|
| 698,004 | 11/1964 | Canada | 118/637 |

*Primary Examiner*—Mervin Stein
*Assistant Examiner*—Douglas Salser

[57] ABSTRACT

A apparatus for developing electrostatic latent images is given whereby there is provided a means for bringing pigmented particles into contact with a coarse surface, means for collecting said pigmented particles, means for supplying an insulating liquid to the pigmented particles, and means to contact said pigmented particles in insulating liquid to the surface of an electrostatic latent image.

7 Claims, 11 Drawing Figures

FIG. 9
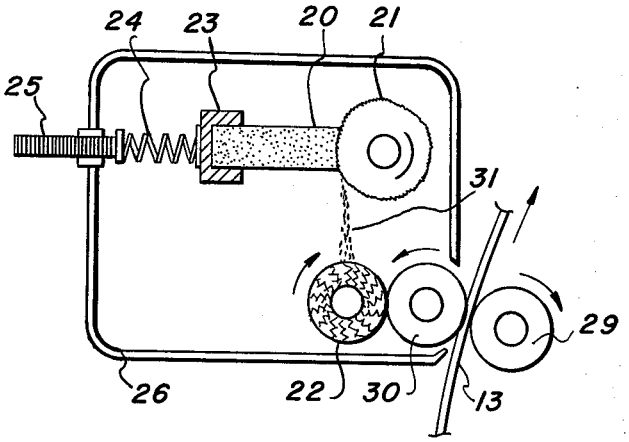
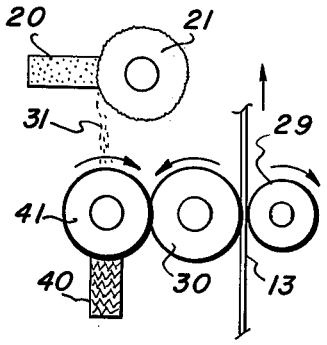
FIG. 10
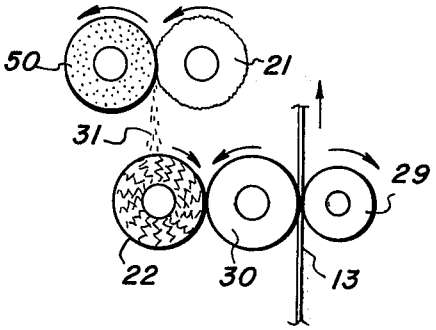
FIG. 11

ABRASIVE LIQUID DEVELOPING APPARATUS

This invention relates to development of electrostatic latent images. More particularly this invention relates to a unique apparatus for accomplishing development of electrostatic latent images.

Many development systems and apparatus configurations are known for making visible images formed by electrostatic means.

The formation and development of images on the surface of photoconductive materials by electrostatic means is well known. The basic electrostatographic process, as taught by Carlson in U.S. Pat. No. 2,297,691, involves placing a uniform electrostatic charge on a photoconductive insulating layer, exposing the layer to a light and shadow image to dissipate the charge on the areas of the layer exposed to the light, and developing the remaining electrostatic latent image by depositing on the image a finely divided electroscopic marking material sometimes called "toner." Toner will normally be attracted to those areas of the layer which retain a charge, thereby forming a toner image corresponding to the electrostatic latent image. This powder image may then be transferred to a support surface such as paper. Such a transferred image may subsequently be permanently affixed. It is well known that a latent image may be formed on an appropriate surface by direct charging in image configuration. Likewise, one may develop and fix an image to a latent image holding substrate.

Development of an electrostatic latent image may also be achieved with liquid rather than dry developer materials. In liquid development commonly referred to as electrophoretic development, an insulating liquid vehicle having finely divided solid marking material dispersed therein contacts the latent image bearing surface in both charged and uncharged areas. Under the influence of the electric field associated with the charged image pattern, these suspended particles migrate toward the charged protions of the imaging surface thus separating out of the insulating liquid.

This invention relates closely to liquid development. The technique outlined above requires close monitoring of the toner concentration and is difficult to use in low volume copying devices since developer dries on the developing apparatus during long periods of inactivity. Moreover, because relatively large volumes of liquid are employed, there is always the danger of leakage and spilling of the developer.

It is an object of this invention to provide for a developing device that is portable, small, convenient and not affected by the above disadvantages. Other objects and advantages will become apparent from a full understanding of the specification.

The present invention accomplishes these objects and others by providing a unique apparatus for developing electrostatic latent images. In accordance with this invention a means is provided for bringing pigmented particles or toner into contact with a coarse or abraiding surface, following which is a means for collecting the toner and contacting the same with a means for providing a insulating liquid to form the developer in small amounts which is then contacted with means to develop an electrostatic latent image with the developer. This invention eliminates all of the above-mentioned disadvantages and provides for a small, portable developing apparatus being capable of home, office, or other use with little or no maintenance.

This invention will be further described with respect to the drawings which represents a few of the many embodiments of the invention.

FIGS. 2, 3, 4, 5, 6, 9, 10 and 11 are longitudinal sectional views of illustrative embodiments of the present invention.

Figure 1:
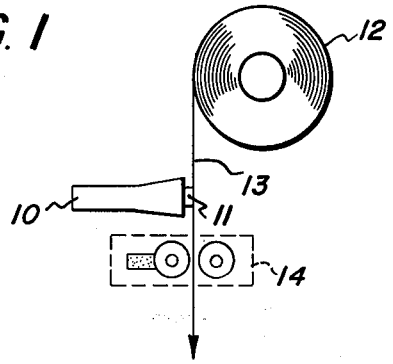
FIG. 1 is a schematic sectional view of an optical latent image forming and developing device or facsimile receiver cooperating with the developing apparatus of this invention.

In the drawings, the numerals represent and designate elements according to the invention as follows in part: pin-tube or optical latent images forming device 10, pin matrix or light transmission device 11, electrostatic recording paper supply 12, developing apparatus 14, solid pigment material 20, coarse roller 21, insulating liquid absorbing roller 22, solid material support 23, tension spring 24, threaded rod 25, housing 26, porous layer of roller 27, pinch roller 29, intermediate roller 30, porous pad 40, roller 41, solid material roller 60, porous material 70, tank 71, fibrous material 72, and fibrous structure 80.

FIG. 1 is a schematic sectional view of a facsimile receiver cooperating with the developing apparatus in accordance with the present invention. 10 shows a pin-tube including a pin-matrix 11. 12 shows an electrostatic recording paper supply roll and 13 an electrostatic recording paper. Onto the surface of the paper an electrostatic latent image may be formed and then developed during passing through a developing apparatus 14 which is indicated with a dashed line. A pin-tube, an electrostatic recording paper, and a system employing these are well known in the art.

Alternatively FIG. 1 represents a schematic sectional view of an optical device for forming and developing latent images. The paper 13 carries a photoconductive insulating layer which is charged by a corotron (not shown) before it passes by the optical device 10. A shadow and light image 11 is exposed onto the photoconductive receiving substrate by the optical device 10 and then the image is developed at developer apparatus 14. Systems for creating such electrostatic latent images are well known. One such system is described in U.S. Pat. No. 2,297,691 which is herein incorporated by reference.

Figure 2:
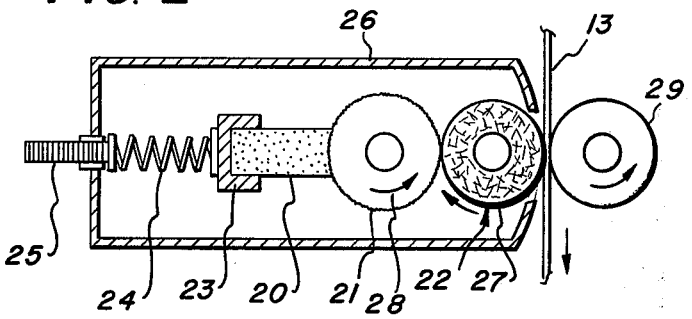

FIG. 2 is a schematic sectional view of a apparatus according to the present invention, and designates the developing apparatus 14 shown with the dashed line in FIG. 1. 20 shows a solid material including the pigmented toner particles of the present invention. This toner which is in bulk form is abraided by roller 21 which holds the so abraided toner. The thin layer of toner formed on the surface of roller 21 comprises finely divided toner and the bulk material in which the toner was held in solid material 20. As will be seen, it is preferred that the bulk material be soluble in the carrier liquid as hereinafter described. The toner particles may be of any convenient size, but it is preferred that they be from about 0.05 to about 0.5 mm.

The surface of roller 21 should be coarse or abrasive in nature so that a thin layer of toner is easily scraped from 20 and carried by roller 21.

The solid material 20 is fixed to the solid material support 23 biased to the roller 21 by a spring 24. 25 shows a threaded rod which adjusts a tension of the spring, and be attached to a housing 26. 22 shows a roller for supplying an insulating or dielectric liquid, which structure includes a liquid absorbing or porous layer 27. Material which may be used here include paper, cloth, felt, sponge, and many others.

As the rollers are rotated in the direction shown by arrow 28, the thin toner layer is transferred from roller 21 to roller 22 carrying the liquid carrier thus forming a layer of liquid developer on the surface of roller 22. The bulk material present on roller 21 is also transferred and disolves in the liquid carrier. The developer containing finely divided toner particles suspended in the insulating carrier liquid are then brought into contact with the recording paper 13 which is carrying an electrostatic latent image. The toner particles deposit onto the latent image forming a visible image.

Pinch roller 29 causes the latent image surface to be biased to the developer carrying surface of roller 22.

It should be noted that an amount of developer is not transferred to sheet 13 and thus remains for subsequent development of other images. Roller 21 acts to replenish the developer on roller 22 and thus image density can be controlled by varying the amount of toner abraided from the solid material 20 by coarse roller 21 by varying the tension on spring 24 by thread rod 25.

Solid material 20 is at least a two component mixture of toner and bulk. The toner may be pigment, graft pigment, resin, or a resin containing pigment. The bulk may be a polymer or other material, preferably one which is soluble in the carrier liquid. The solid material may be formed in any convenient fashion. One of many recognized and known techniques is to mix pigment with a resin soluble in the carrier liquid, partially dry the mixture, and compress the remaining solids into a cake. Alternatively the mixed pigment and polymer may be further dispersed in pitch or asphalt or the like, and then compressed. The solid material 20 may contain from about 1 to almost 100 percent pigment.

The surface of roller should be relatively hard when comparing the same with the solid material to be abraided, and it should be course. Any material may be employed. For example, a metallic or other hard surface may have the surface characteristics of a file or grinding wheel. A brush roller may also be used. When solid material 21 is relatively soft, roller 21 may be of softer materials such as spongy felt, cloth, paper, and so on. A magnetic brush as is well known in electrophotography is also useful.

Insulating liquids usable in the present invention include cyclohexane, benzene, pentane, heptane, decalin, and many other nonpolar materials, petroleum, carbon tetrachloride, trichloroethylene, chlorofluoride-ethylene, toluene, xylene, and mixtures thereof, and many other insulating liquids.

Figure 3:
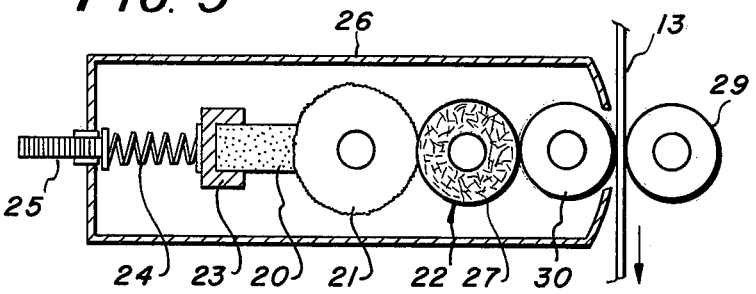

FIG. 3 is an improvement of the embodiment shown in FIG. 2. A feature of this improved apparatus includes a transfer roller 30. In the embodiment shown in FIG. 2, the suspension of toner particles formed at the roller surface 22 is immediately brought into contact with the latent image surface, however an unbalanced distribution of pigment in the developed images may be obtained corresponding to areas of prior development. Also, in some cases small masses of toner particles may be brought into contact with the latent image before the toner particles have had time to be suspended; thus, the toner may adhere to the latent images in a mass shape so that clear images cannot be obtained. By transferring the toner suspension from the surface of roller 22 to transfer roller 30, the size and concentration of toner particles included in the suspension layer at the surface of roller 30 can be kept uniform. Additional transfer rollers can be employed as desired. Yet another and further reason for using a transfer roll is that the roller 29 and 22 are not brought into contact with each other directly during absence of the recording paper. When the roller 29 contacts immediately with the roller 22, a quantity of toner adheres onto the surface of 29 and tends to contaminate the back side of the recording paper. It is desirable that the surface of transfer roller 30 be coarsed or capable of maintaining a liquid layer on its surface.

Figure 4:
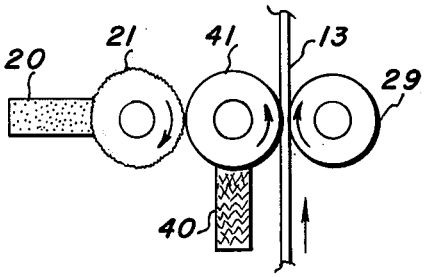

FIG. 4 is a schematic sectional view of yet another embodiment of the present invention. In the embodiments shown in FIGS. 2 and 3, roller 22 is covered with a porous material for supplying an insulating liquid. In the embodiment shown in FIG. 4 a porous pad 40 which carries the liquid is employed. A further feature is that the thin layer including toner particles formed at the surface of the roller 21 is transferred to the transfer roller 41 and then coated with an insulating liquid by the pad 40. Accordingly, the supply of insulating liquid is achieved simply, and that more importantly the solid material 20 is prevented from being wetted by liquid adhered to the surface of roller 21. When the solid material 20 is wetted by the insulating liquid adhered to the surface of roller 21, that material tends to become fixed to the roller 21 during stopping of apparatus operation for a long period of time. Also, liquid drops tend to result at the end of solid material 20 depending on the amount of insulating liquid carried by the surface of roller 21.

Figure 5:
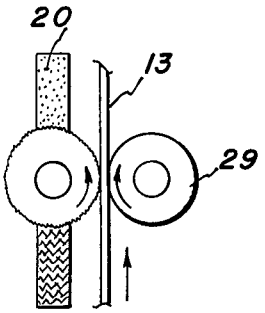

FIG. 5 is a modification of the embodiment shown in FIG. 4. A feature of the embodiment shown in FIG. 5 is in the fact that the solid material 20 is just above the roller 21 so that the solid material 20 is prevented from wetting by the insulating liquid formed onto the surface of roller 21, and the apparatus may begin to operate with reliability after a long stopping period.

Figure 6:
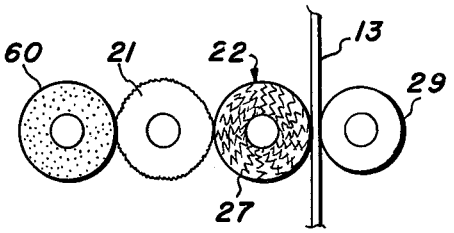

FIG. 6 is a schematic sectional view of another embodiment according to the present invention.

A feature of the embodiment shown in FIG. 6 is instead of the solid material 20 as shown in the above described embodiments a molding solid material is shaped to a roller 60. When the surface of the roller 21 is scratched, in the embodiments shown in FIGS. 2, 3, 4 and 5, the obtained images are striped ones, but in this embodiment this does not substantially occur.

In the above described embodiments, an endless belt is available instead of the roller 21. Also the end of the solid material is prevented from wetting by liquids by means of automatic separation of the solid material and the roller 21 accompanying with stopping of the apparatus in the present invention.

Figure 7:
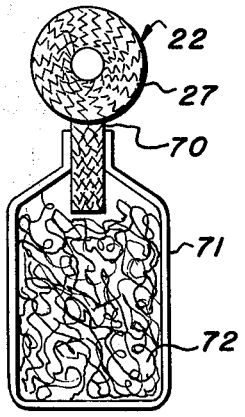
FIGS. 7 and 8 are schematic longitudinal sectional views of some components of the above embodiments.
Figure 8:
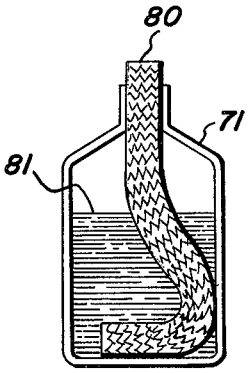

FIGS. 7 and 8 are sectional views for supplying an insulating liquid to a thin layer of toner particles. As seen in FIG. 7, an apparatus for supplying a liquid to roller 22 having a porous layer 27 is shown. 70 is a porous material. 71 is a tank in which a fibrous material is loaded and in which an insulating liquid is contained. The fibrous material 72 may be a thread, wool, glass fiber, and the like. The liquid absorbed in the fibrous material 72 is transmitted through the porous material 70 by means of capillary action and then absorbed into porous layer 27 of roller 22. According to the structure of FIG. 7, an insulating liquid cannot be easily spilled from a fallen tank 71.

As seen in FIG. 8, 80 is a fibrous structure absorbing an insulating liquid by means of capillary action. 81 is an insulating liquid loaded in the tank 71. One end of the structure 80 is in the liquid so that the liquid is transmitted through the structure to its other end. The one end of structure 80 corresponds to the pad 40 in the embodiment of FIG. 4. The structure of FIG. 8 also is safe that the liquid cannot be easily spilled from the tank. Both structures of FIGS. 7 and 8 can maintain the wetness of pad 40 or the porous layer 27 of roller 22.

FIG. 9 is a sectional view of another embodiment of the apparatus in the present invention. The rollers 21 and 22 are apart from each other in the direction of top and bottom, and both are disposed in such relation that the powders 31 which included the toner particles scraped from the solid material 20 fall onto the surface of roller 22. This operation also can be in such manner that the powders which include the toner particles formed at the surface roller 21, are scraped onto the surface of roller 22 by a blade. The remaining constructions are the same as described in FIG. 3.

FIGS. 10 and 11 are modifications of the apparatus shown in FIGS. 4 and 6, and both scrapes the solid material and collect the same to suspend them in the insulating liquid. In each embodiment shown in FIGS. 9, 10 and 11, the powders or bulk material and toner particles formed at the surface of roller 21, fall by gravity to the roller 22 or 41.

The apparatus of the present invention is similar to that of Japanese published Patent No. 38–11095 from the view point of using the solid material. However, the apparatus of the above published patent is entirely different from that of the present invention because there the solid material is directly disolved by the carrier liqued. This results in a difference in the ability to make and hold adequate toner concentration which is being provided.

In order to more fully describe this invention the following examples are presented. However, these examples are non-limitive of the invention which should only be interpreted in the light of the claims. All parts and percentages are by weight unless otherwise stated.

EXAMPLE I

The apparatus of FIG. 4 was constructed. The solid material was 'Straight Asphalt' formed in 20 × 60 × 200 mm (Kokonoe Electric Co., Ltd.). The roller 21 was a hollow brass roller, 50 mm diameter, of which the surface was etched in a net pattern. The size of net was 200 mesh and the depth approximately 50 microns. The force biasing the solid material to the roller 21 was 50 gram/cm. The roller 41 was a hollow roller of 40 mm diameter including the brass 2 mm thickness overcoated with urethane rubber having 5 mm thickness. The surface of the urethane rubber was coarse having fine irregularities. Pad 40 was a felt having 20 mm thickness and 200 mm width, one end of which, as the fibrous structure shown in FIG. 8, was immersed in the insulating liquid filled in a tank. The insulating liquid was an isoparaffinic hydrocarbon, Isopar H (Esso Standard Oil Inc.). Each of rollers was rotated at a drum speed of 4 cm/sec in the direction of arrow in FIG. 4. The latent image imposed negative charge was formed onto the recording paper by a recording needle. The recording paper was a high quality paper having 80 microns thickness, on which a insulating layer was coated. Developed toner images were fixed by natural drying. The images obtained were sharp and clear without fogging. The images were colored in sepia. The pinch roller was a stainless steel roller having a 10 mm diameter coated with a urethane rubber of 4 mm thickness. The recording paper immediately after the development was almost dried.

EXAMPLE II

The solid material was formed as follows:

One part of ethylcellulose was dissolved in 9 parts of tetrachloroethane, and 1 part of carbon black powder was added thereto. This mixture was agitated and mixed for 4 hours on a ball/mill and dried to form flakes. Next, 1 part of this flake was mixed and agitated with coumaronindene resin dissolved in 5 parts of toluene by weight and dried. This material was used in the apparatus shown in FIG. 3, molded in the shape shown, the same as the above described Example I. A suitable insulating liquid was made from a mixture of kerosine and 2 percent toluene. The insulating liquid of this example was supplied according to the provisions of FIG. 1. The pad absorbed the liquid which was then brought into contact with the porous layered roller wetting the same. The roller 22 was a stainless roller of 10 mm diameter, the outer surface of which was overcoated with a felt of 10 mm thickness. The transfer roller was brass having 20 mm diameter, the outer surface of which was overcoated with a metallic net of 200 meshe, and the retaining roller 29 was the same as that used in Example I. The obtained images were clear and of good quality.

What is claimed is:

1. A developing apparatus for making visible electrostatic latent images comprising a means for bringing a solid material comprising toner particles into contact with a coarse surface member, means for abrading said solid material, means for collecting said toner particles on the surface of a roller, means for contacting said surface with a carrier liquid, and means for bringing said carrier liquid containing toner particles into contact with a latent image bearing surface.

2. The apparatus of claim 1 wherein said means for bringing the solid material into contact with a coarse surface member comprises a spring loaded surface of solid material in contact with a roller having an abrasive rotating surface.

3. The apparatus of claim 2 wherein said solid material is a bar of solid material.

4. The apparatus of claim 1 wherein said coarse member carries said toner particles away from the solid material.

5. The apparatus of claim 1 wherein the carrier liquid is substantially carried on the surface of the collecting roller.

6. The apparatus of claim 1 wherein the carrier liquid is supplied to the surface of the collecting roller by contacting the surface with a pad containing said carrier liquid.

7. The apparatus of claim 1 wherein the dispersed toner in a carrier liquid is transferred to a transfer roller to contact the latent image bearing surface.

* * * * *